US008346139B2

(12) United States Patent
Okamoto

(10) Patent No.: US 8,346,139 B2
(45) Date of Patent: Jan. 1, 2013

(54) BELT UNIT AND IMAGE FORMING DEVICE EQUIPPED THEREWITH

(75) Inventor: Masaya Okamoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 371 days.

(21) Appl. No.: 12/610,637

(22) Filed: Nov. 2, 2009

(65) Prior Publication Data

US 2010/0310283 A1 Dec. 9, 2010

(30) Foreign Application Priority Data

Jun. 8, 2009 (JP) ..... 2009-137201

(51) Int. Cl.
*G03G 15/01* (2006.01)

(52) U.S. Cl. ..... 399/302

(58) Field of Classification Search ..... 399/121, 399/302, 303
See application file for complete search history.

(56) References Cited

U.S. PATENT DOCUMENTS 7,054,585 B2 * 5/2006 Sasamoto et al. ..... 399/299

FOREIGN PATENT DOCUMENTS

JP 3997051 B 8/2007

* cited by examiner

*Primary Examiner* — Walter L Lindsay, Jr.
*Assistant Examiner* — Frederick Wenderoth
(74) *Attorney, Agent, or Firm* — Sughrue Mion, PLLC

(57) ABSTRACT

There is provided a belt unit including: a fixed frame at which a transfer roller is provided; plural fixed side supporting rollers provided at the fixed frame; a movable frame that is swingably mounted to the fixed frame, and at which plural transfer rollers are provided; a movable side supporting roller provided at the movable frame; and an endless belt stretched around the fixed side supporting rollers and the movable side supporting roller, and contacting the transfer roller provided at the fixed frame and the transfer rollers supported at the movable frame, and contacting plural photoreceptor drums, wherein a swinging center of the movable frame is a center of belt portions at both sides of the swinging center, and in a monochrome mode, the movable frame is swung and moves the belt away from the photoreceptor drums other than the photoreceptor drum that is used in the monochrome mode.

17 Claims, 17 Drawing Sheets

BELT UNIT AND IMAGE FORMING DEVICE EQUIPPED THEREWITH

CROSS-REFERENCE TO RELATED APPLICATION

This application claims priority under 35 USC 119 from Japanese Patent Application No. 2009-137201 filed on Jun. 8, 2009.

BACKGROUND

1. Technical Field

The present invention relates to a belt unit, and to an image forming device equipped therewith.

2. Related Art

Image forming devices often utilize a belt unit that forms an intermediate transfer belt, a sheet conveying belt, or the like.

Color image forming devices have a switching mechanism that switches a state of contact between, in a monochrome mode, a state of making a belt contact a photoreceptor drum for monochrome, and, in a color mode, a state of making the belt contact plural photoreceptor drums including the photoreceptor drum for monochrome.

SUMMARY

The present invention provides a belt unit including:

a fixed frame at which a transfer roller is provided;

plural fixed side supporting rollers provided at the fixed frame;

a movable frame that is swingably mounted to the fixed frame, and at which plural transfer rollers are provided;

a movable side supporting roller provided at the movable frame; and an endless belt stretched around the fixed side supporting rollers and the movable side supporting roller, and contacting the transfer roller provided at the fixed frame and the transfer rollers supported at the movable frame, and contacting plural photoreceptor drums, wherein a swinging center of the movable frame is a center of belt portions at both sides of the swinging center, and in a monochrome mode, the movable frame is swung and moves the belt away from the photoreceptor drums other than the photoreceptor drum that is used in the monochrome mode.

BRIEF DESCRIPTION OF THE DRAWINGS

An exemplary embodiment of the present invention will be described in detail based on the following figures, wherein.

DETAILED DESCRIPTION

Figure 1:
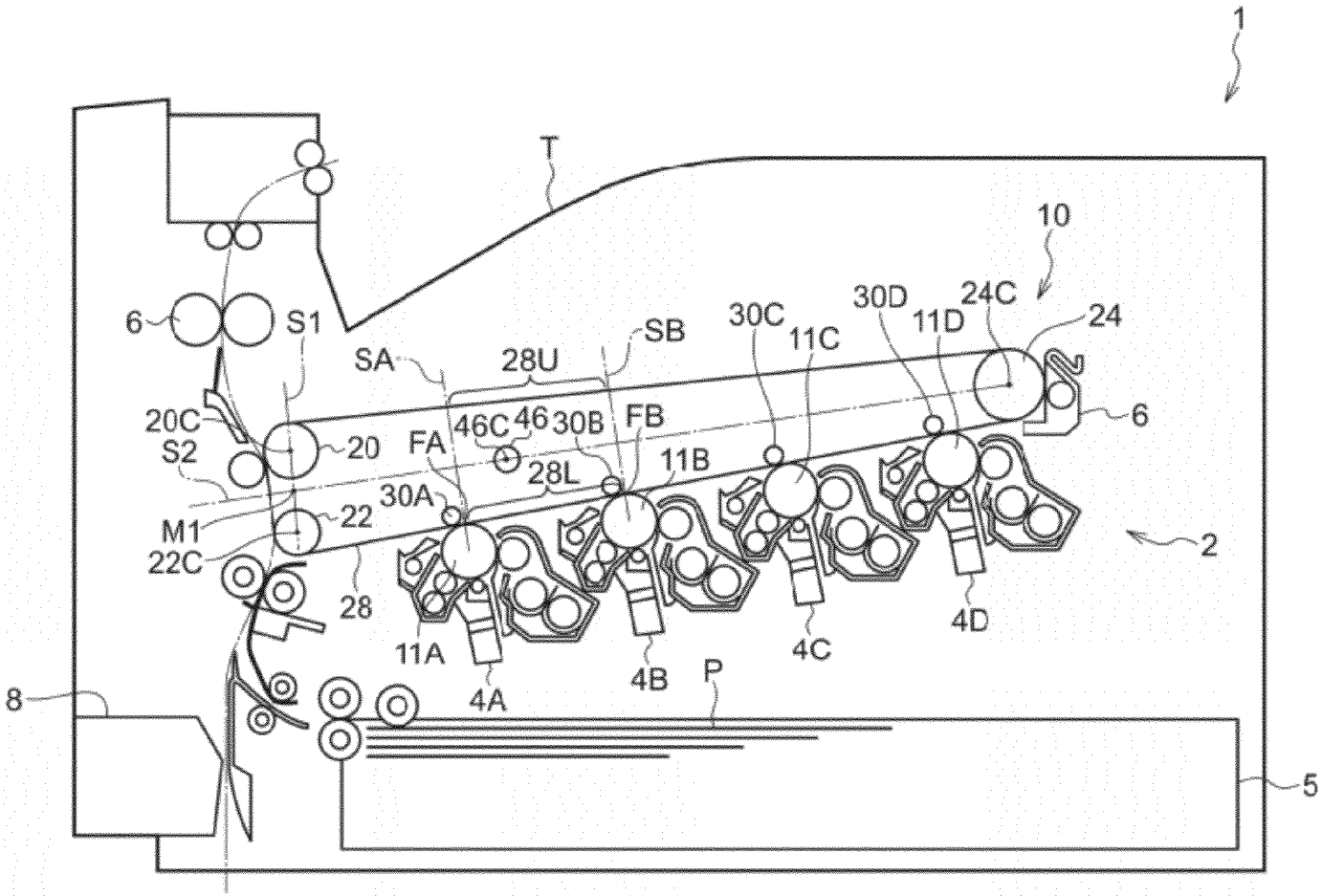
FIG. 1 is a schematic side sectional view showing the structure of an image forming device relating to an exemplary embodiment of the present invention.
Figure 2:
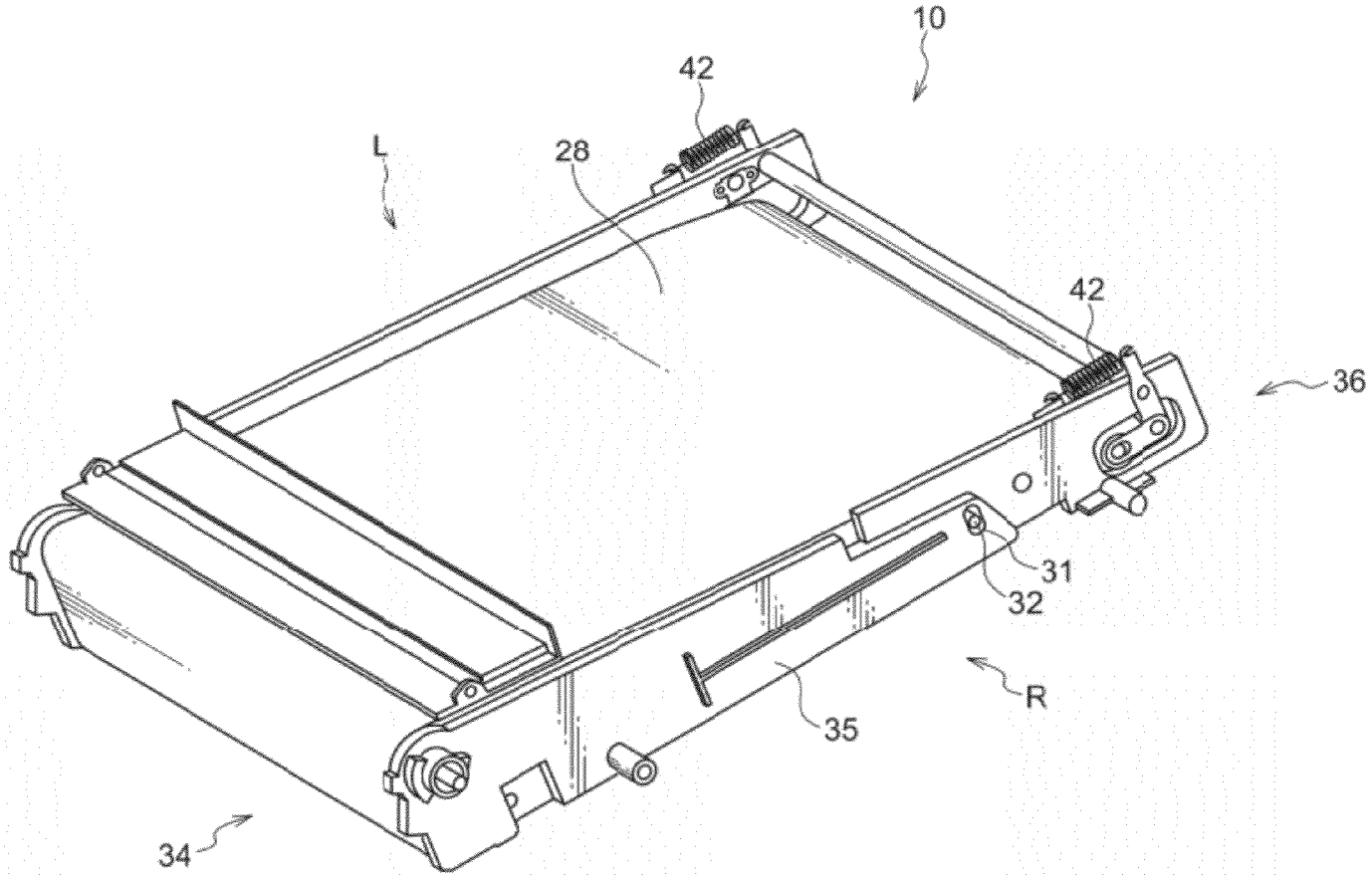
FIG. 2 is a perspective view of a belt unit relating to the exemplary embodiment of the present invention.

An exemplary embodiment of the present invention will be described hereinafter by using an example. As shown in FIG. 1 and FIG. 2, an image forming section (hereinafter called print head device) 2, that has plural photoreceptor drums and process units such as developing units and the like and that carries out color image formation, and a belt unit 10, that is disposed above the print head device 2, are provided within a printer 1 relating to the exemplary embodiment of the present invention. Four photoreceptor drums (image holders) 11A-D, and exposure sections 4A-D, that respectively carry out image exposure on the four photoreceptor drums (image holders) 11A-D, are provided at the print head device 2. Further, the printer 1 has a sheet feeding cassette 5 that feeds transfer sheets P serving as transfer materials to the print head device 2, a fixing device 6 that carries out fixing processing on the transfer sheet P on which a toner image has been transferred from the print head device 2, a manual feed section 8 at which desired transfer sheets P are fed, and a control section (not illustrated) formed from control circuits that control the operations of the printer, image processing circuits that carry out image processings on image signals, and the like. Note that, in FIG. 1, T denotes a discharging section to which the transfer sheets P on which images have been formed are discharged, and this discharging section T is disposed integrally with the upper portion of the printer 1.

Among the four photoreceptor drums 11A-D, the photoreceptor drum 11A that is disposed at the left end side and lowest end in FIG. 1 is a photoreceptor drum for monochrome (for black). The photoreceptor drums 11B-D are photoreceptor drums for the respective colors of cyan (C), magenta (M), and yellow (Y).

(Belt Unit and Swinging Mechanism Thereof)

The belt unit 10, that contacts the photoreceptor drums 11A-D, is provided at the printer 1. The belt unit 10 has supporting rollers 20, 22 that are disposed at the left end side in FIG. 1, a steering roller 24 that is disposed at the upper end position of the belt unit 10 at the right end side in FIG. 1, and an endless belt (intermediate transfer belt) 28 that is stretched around the supporting rollers 20, 22 and the steering roller 24. The steering roller 24 adjusts meandering of the belt 28 and also functions as a supporting roller. The supporting rollers 20, 22 and the steering roller 24 are disposed at positions that form a substantially isosceles triangle when viewed from the side.

The belt 28 is rotated and driven due to rotational driving force being transmitted to the upper supporting roller 20 among the supporting rollers 20, 22. Further, a contact surface between the belt 28 and the sheet is formed at the belt surface between the supporting roller 20 and a secondary transfer opposing roller. Note that a structure may be utilized in which rotational driving force is transmitted to the lower supporting roller 22 among the supporting rollers 20, 22.

Figure 3:
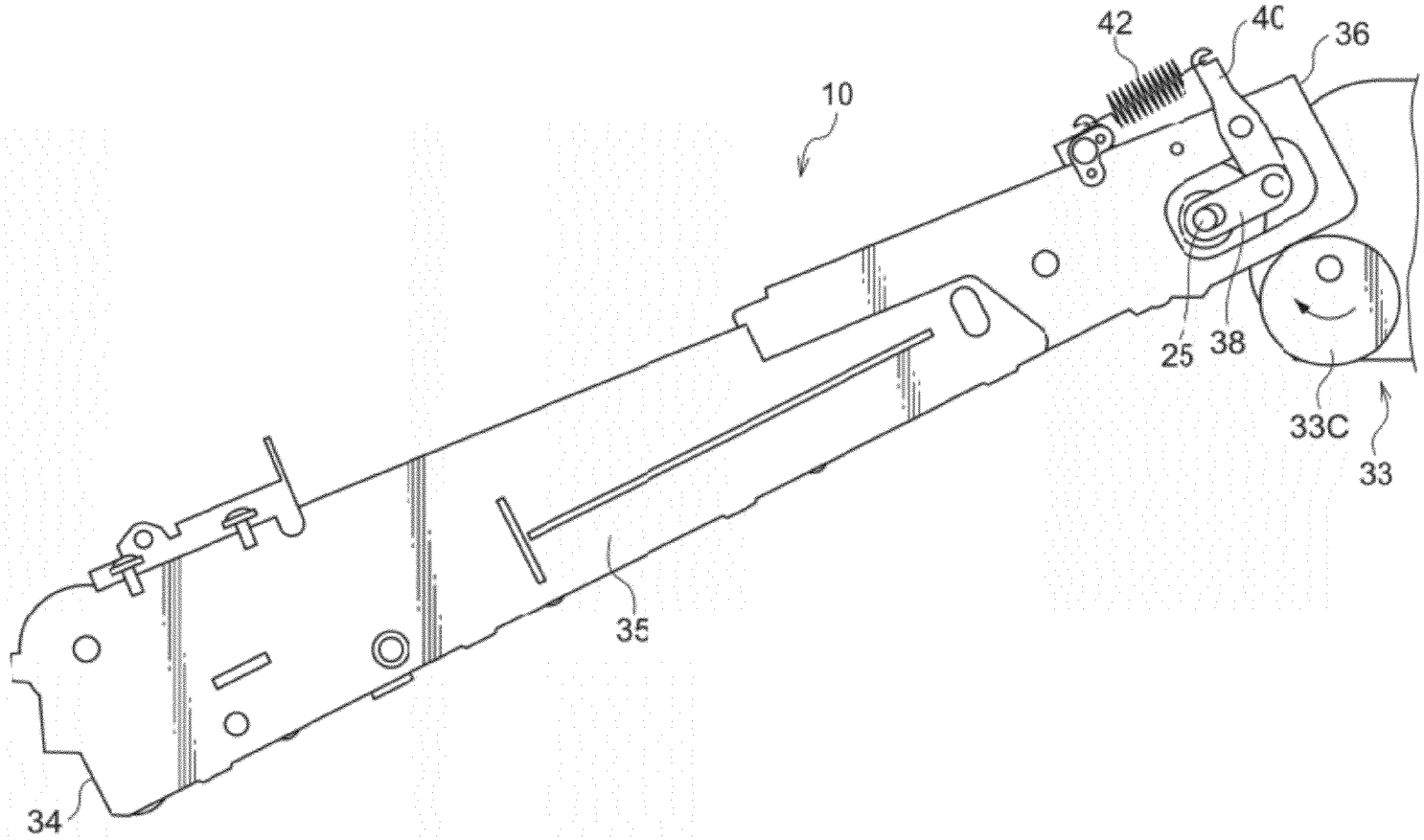
FIG. 3 is a side view of the belt unit relating to the exemplary embodiment of the present invention.
Figure 4:
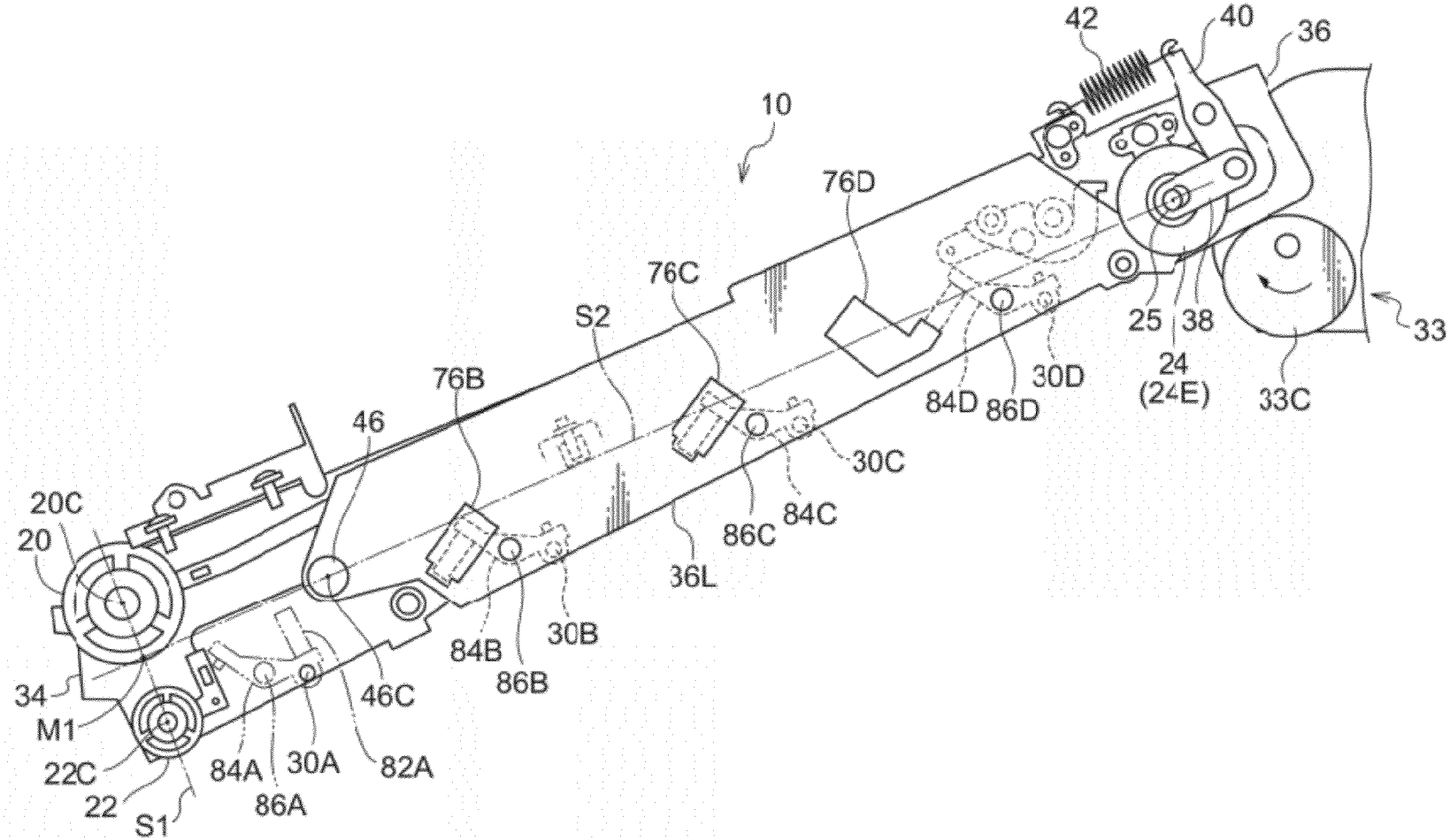
FIG. 4 is a side view explaining a structure in which a movable frame can swing, at the belt unit relating to the exemplary embodiment of the present invention.

As shown in FIG. 2 through FIG. 4, the belt unit 10 has a frame 34 that is fixed (hereinafter called fixed frame 34) that rotatably supports the supporting rollers 20, 22 and a primary transfer roller 30A that is fixed as will be described later (a frame for rotatably supporting the supporting rollers 20, 22 and supporting the belt), and a frame 36 that is movable (hereinafter called movable frame) that rotatably supports the steering roller 24 and primary transfer rollers 30B-D that move (a frame that supports the belt, and, at the time of a belt approaching/separating operation, can move and separates the primary transfer rollers from the surfaces of the photoreceptor drums).

At one side portion R in the belt transverse direction, a fixed frame side portion 35 extends to the positions of the primary transfer rollers 30B-D, as compared with at another side portion L in the belt transverse direction. A guide groove hole 31 (see FIG. 2) running along an arcuate direction that is centered around a swinging center 46C that will be described later, is formed in the extended end side of the fixed frame side portion 35. A stopper 32 (see FIG. 2) that is inserted in the guide groove hole 31 is formed at the movable frame 36.

Figure 16:
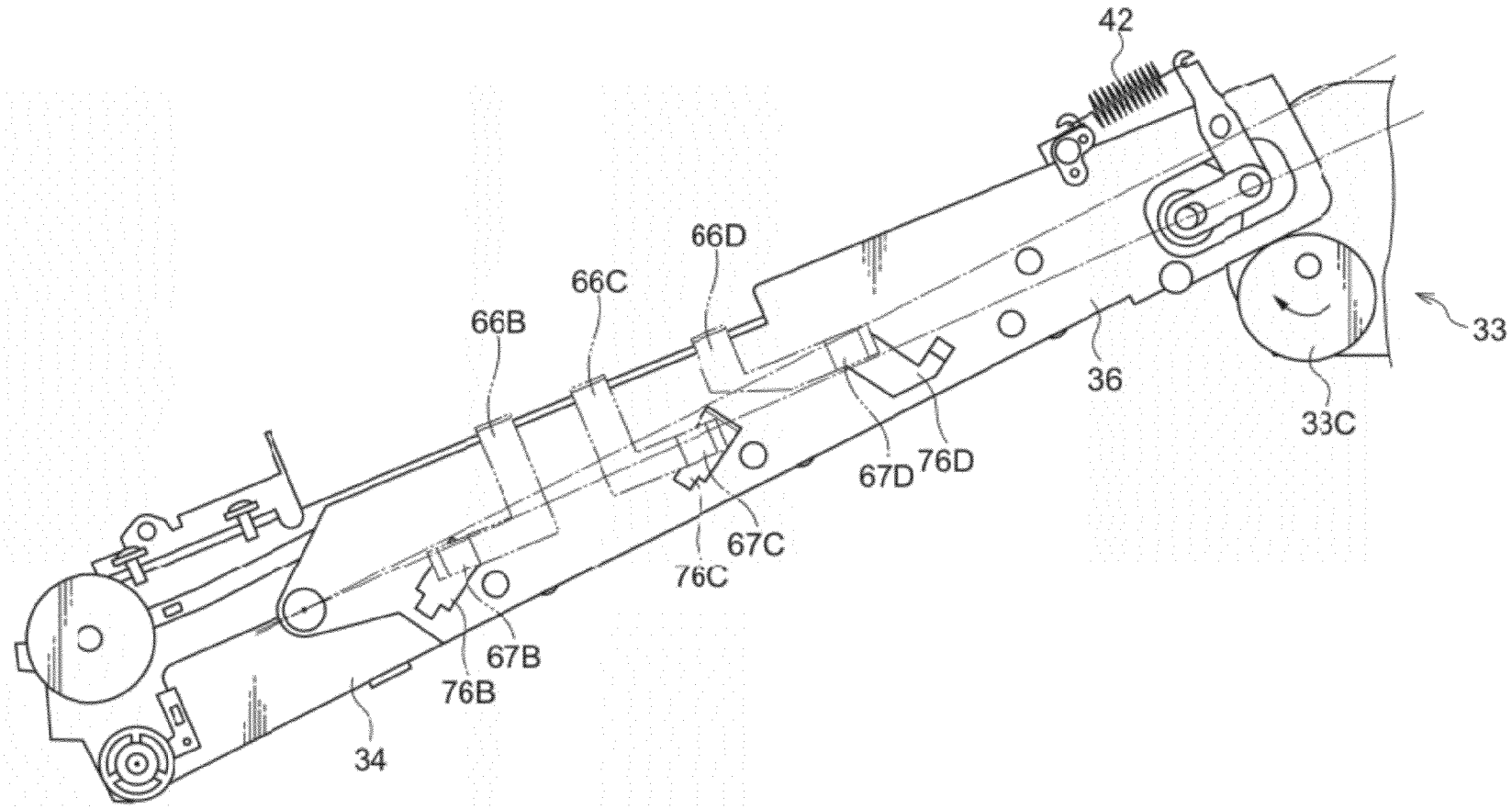
FIG. 16 is a side view explaining the conductive plate portion at the fixed frame side and the conductive plate portion at the movable frame side always contacting while sliding at the belt unit relating to the exemplary embodiment of the present invention (the state of the color mode)
Figure 17:
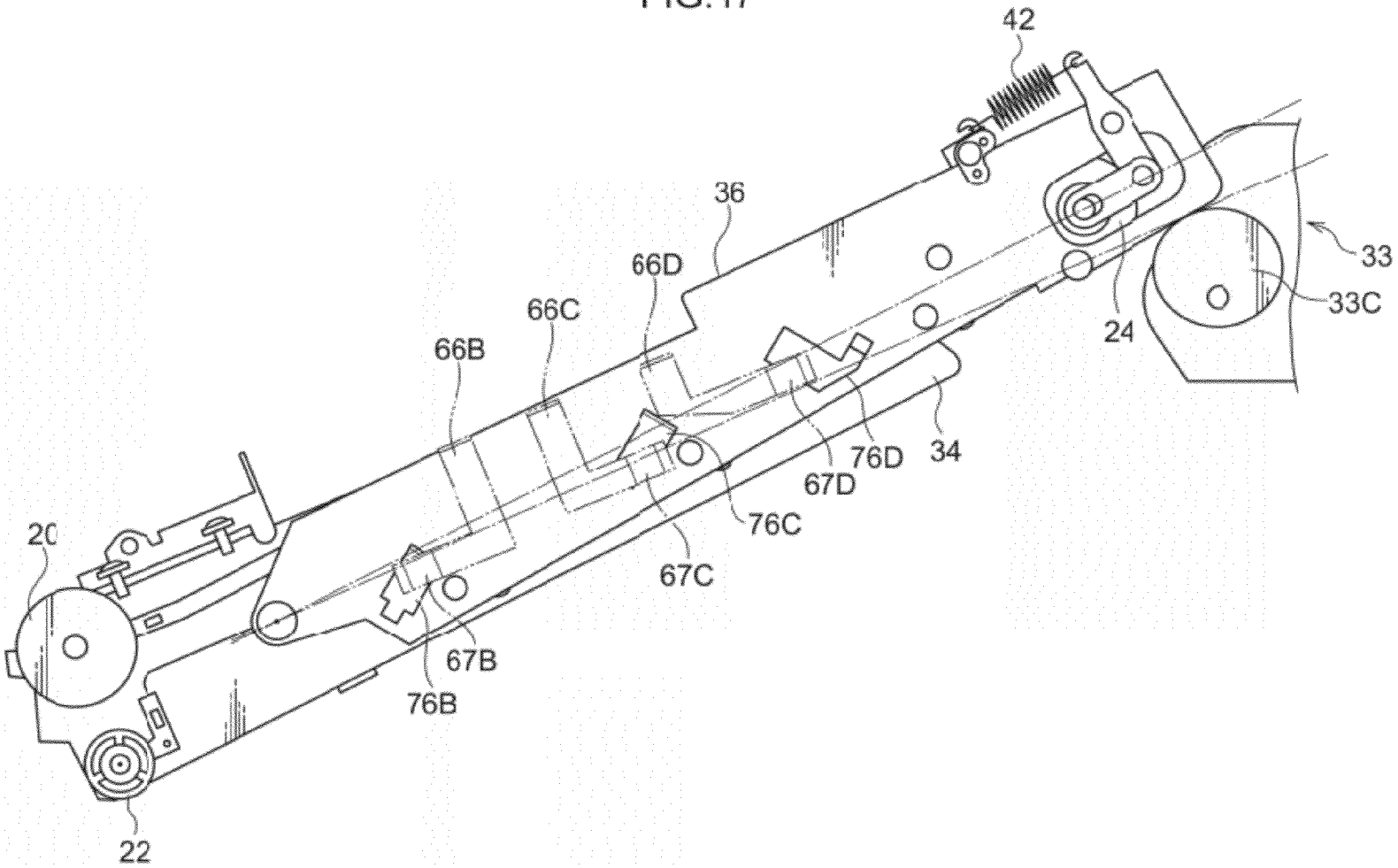
FIG. 17 is a side view explaining the conductive plate portion at the fixed frame side and the conductive plate portion at the movable frame side always contacting while sliding at the belt unit relating to the exemplary embodiment of the present invention (the state of the monochrome mode).

As shown in FIG. 3 and FIG. 4, a cam mechanism 33 is provided at the printer 1. The cam mechanism 33 has a cam 33C that abuts, from below, the end portion of the movable frame at the side at which the steering roller 24 is disposed. Due to rotation of the cam 33C, in the color mode, the primary transfer roller 30A and the primary transfer rollers 30B-D are positioned on a straight line, and are all in states of contacting the belt 28 (see FIG. 4 and FIG. 16). In the monochrome mode, the movable frame 36 is swung upward (see FIG. 17), and the primary transfer roller 30A contacts the belt 28, and the primary transfer rollers 30B-D are in states of being separated from and not contacting the belt 28.

As shown in FIG. 4, end portions of the primary transfer rollers 30B-D are rotatably held by electrically conductive holding members 84B-D respectively that will be described later, and are positioned by being urged toward a lower edge portion 36L of the movable frame 36.

The primary transfer roller 30A and the primary transfer rollers 30B-D are provided at the belt unit 10 in order to transfer toner images onto the outer peripheral surface of the belt 28, or onto a sheet that is conveyed between the photoreceptor drums 11A-D and the belt 28. Note that a waste toner box, in which waste toner is housed, and a stirring/conveying member, that conveys the waste toner to the waste toner box, are provided at the movable frame 36.

Figure 5:
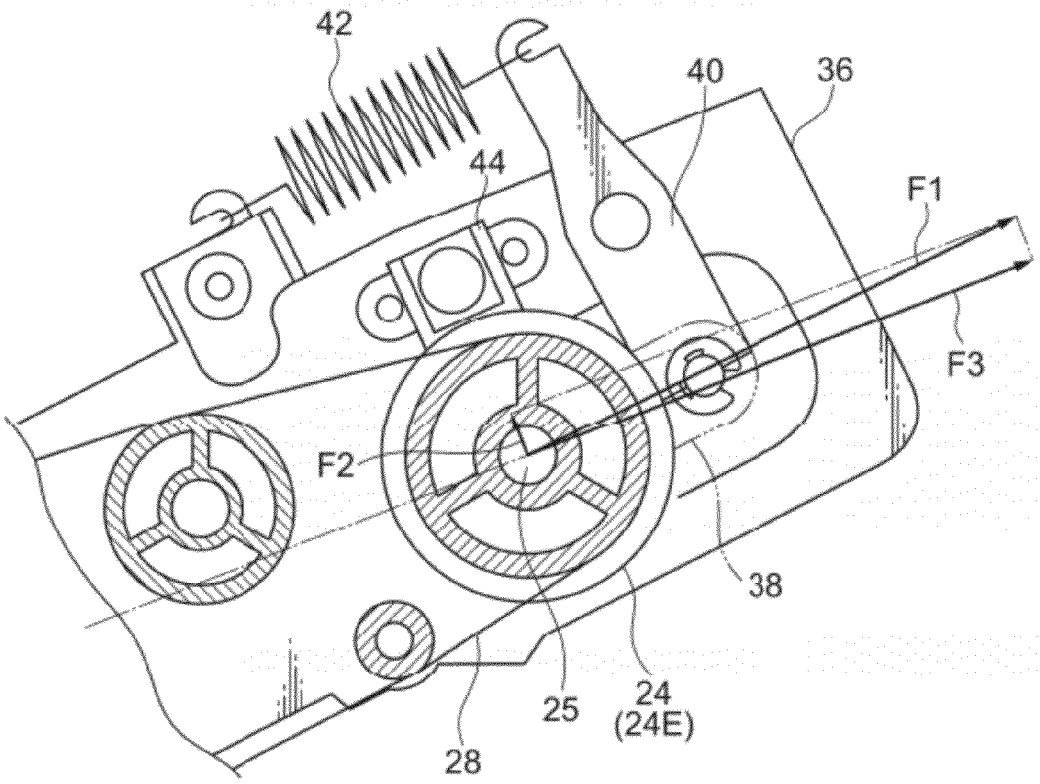
FIG. 5 is a partial enlarged side sectional view of the belt unit relating to the exemplary embodiment of the present invention.

As shown in FIG. 3 and FIG. 5, provided at the both end portion sides of the steering roller 24 are: tensing shaft plates 38 that are mounted to a shaft portion 25 of the steering roller 24 and extend in directions of applying tensile force to the belt 28 at the steering roller 24, rotating plates 40 that are shaped as slender plates and are mounted so as to be able to rotate around the axis of the steering roller 24 in order to apply force in a direction along the belt tensing direction to the tensing shaft plates 38 at the lower end portions of the rotating plates 40, and tension coil springs 42 whose end portions are fixed to the upper end portions of the rotating plates 40 and to the upper portion of the movable frame 36.

Figure 6:
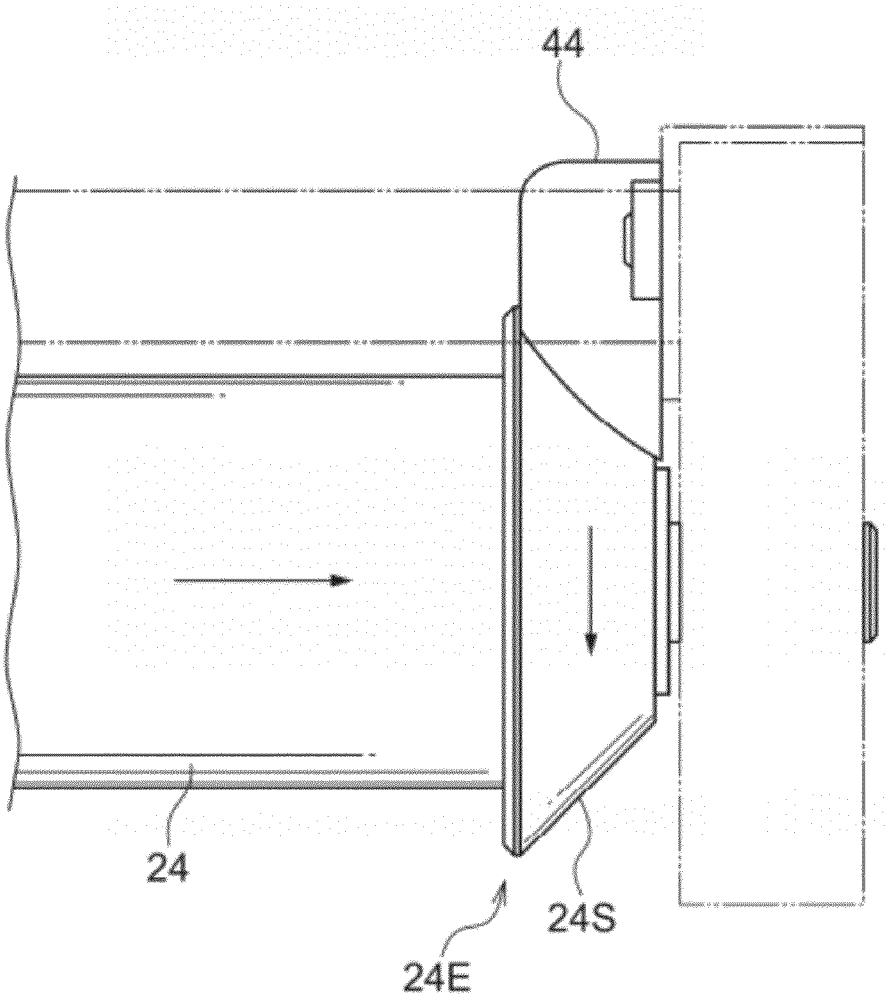
FIG. 6 is an explanatory drawing explaining restricting of the position of an end portion of a steering roller, at the belt unit relating to the exemplary embodiment of the present invention.
Figure 7:
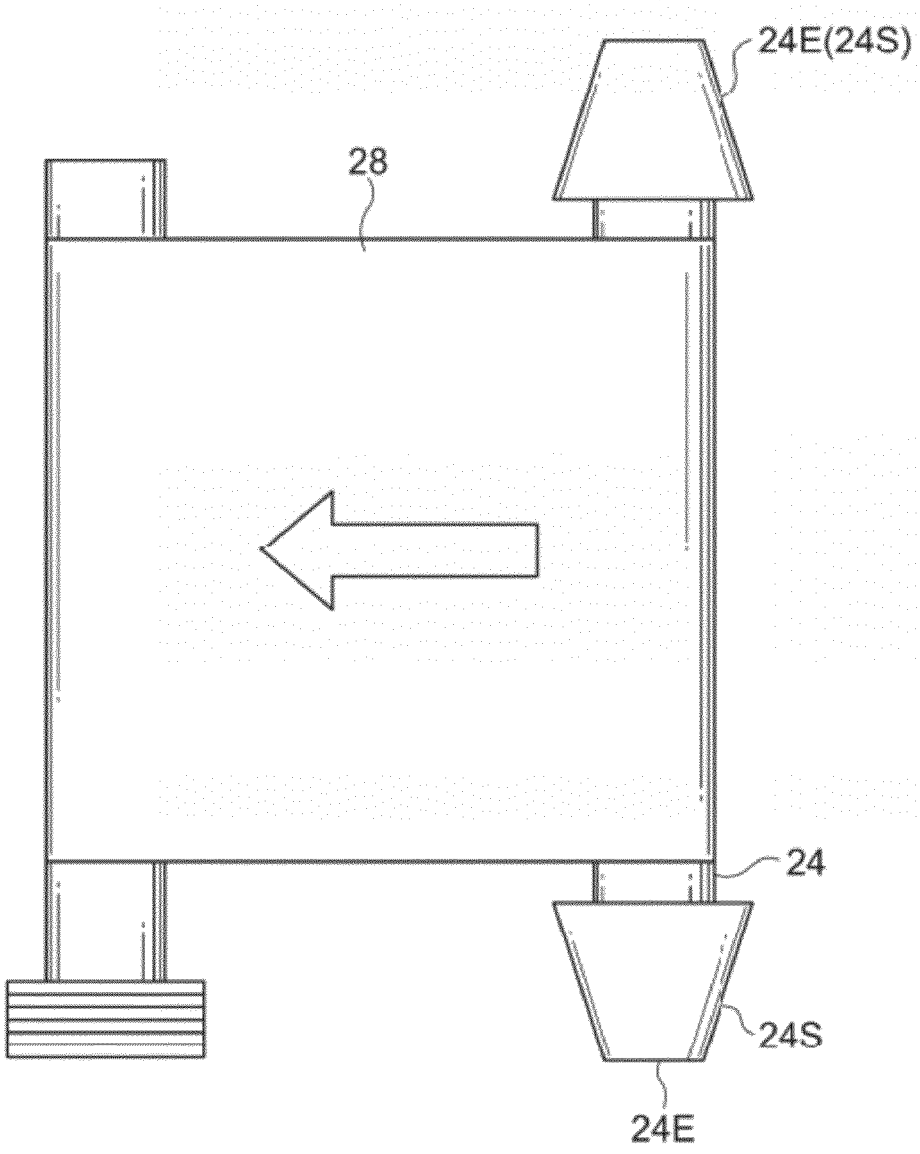
FIG. 7 is an explanatory drawing explaining meandering of a belt being corrected by restricting of the positions of the end portions of the steering roller, at the belt unit relating to the exemplary embodiment of the present invention.
Figure 8:
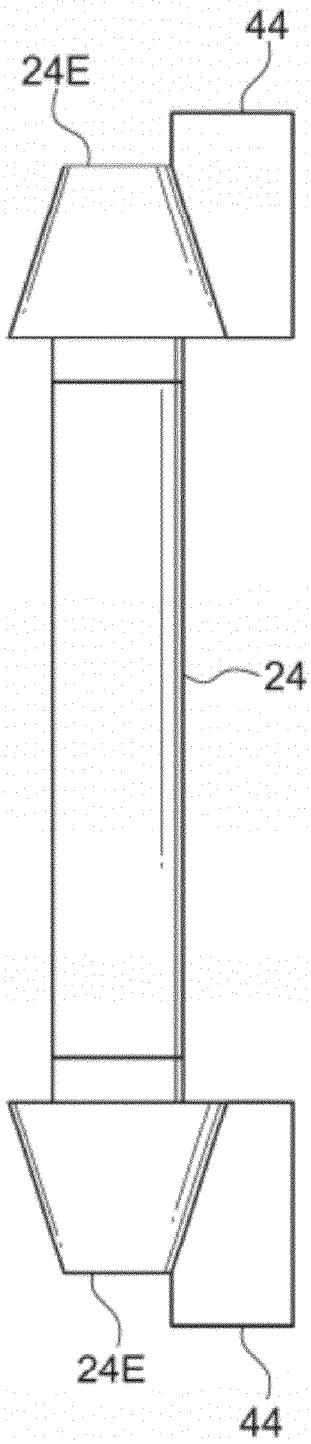
FIG. 8 is an explanatory drawing explaining the steering roller returning to a stable state even when meandering force is applied, at the belt unit relating to the exemplary embodiment of the present invention.

As shown in FIG. 6 through FIG. 8, end portion members 24E, that have substantially truncated conical inclined surfaces 24S whose outer diameters change at a constant slope along the axial direction of the steering roller 24, are provided at the both end portions of the steering roller 24 for carrying out meandering adjustment of the belt 28. Blocks (fixing members) 44, that contact the inclined surfaces 24S, are mounted to the both end sides of the steering roller 24 at the movable frame 36. The positions of the end portion members 24E are restricted by the blocks 44. Namely, during traveling of the belt as shown in FIG. 7, the blocks 44 are disposed at the both end sides of the steering roller 24 and the inclined surfaces 24S of the end portion members 24E abut the blocks 44 as shown in FIG. 8.

Due to this structure, the steering roller 24 is urged so as to stretch the belt 28, and moves in a direction orthogonal to the feeding direction of the belt 28 so as to carry out adjustment of meandering of the belt 28.

Namely, when force that moves the vertical direction position of the steering roller 24 is applied by the rotational movement of the belt 28, the end portion members 24E move in the vertical direction along the inclined surfaces 24S due to the blocks 44. As a result, force that steers is generated.

On the other hand, as shown in FIG. 5, spring tensile forces F1 are applied to the steering roller 24 from the tensing shaft plates 38 by the tension coil springs 42. Here, in terms of the vector components, the spring tensile force F1 can be divided into a pressure-imparting direction force F2 that pushes the end portion member 24E toward the block 44, and a belt tensing force F3 that is orthogonal to the pressure-imparting direction force F2. Accordingly, this is a structure in which it suffices to not separately provide a mechanism that imparts the pressure-imparting direction force F2 and a mechanism that imparts the belt tensile force F3.

Figure 9:
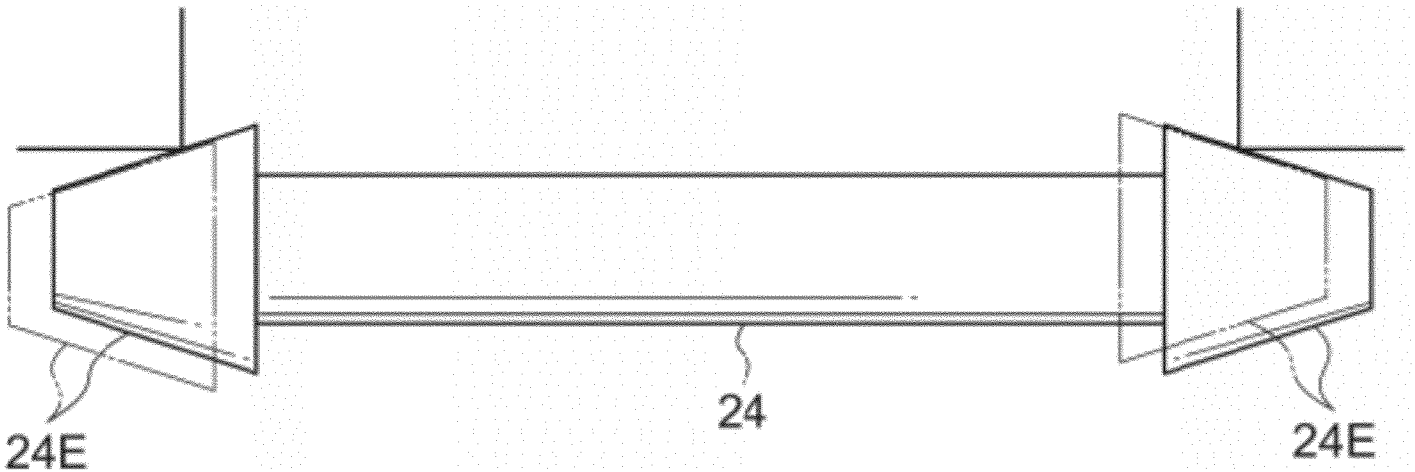
FIG. 9 is an explanatory drawing explaining a steering angle being ensured, at the belt unit relating to the exemplary embodiment of the present invention.

The end portion members 24E and the blocks 44 are provided at the both end sides of the steering roller 24. As a result, as shown in FIG. 9, the steering roller 24 is a structure that moves in the axial direction as well, and, further, the rotational center of the steering angle is the substantially central portion in the longitudinal direction of the steering roller 24. Due thereto, a steering angle that is twice as large is ensured as compared with a case in which one end side of the steering roller is made to be the rotational center of the steering angle. Further, frictional force of the axial direction movement of the steering roller 24 is offset, and the operational stability improves.

Further, as shown in FIG. 4, the belt unit 10 has a shaft portion 46 that swingably connects the movable frame 36 to the fixed frame 34. The position at which the center of the shaft portion 46 is disposed, i.e., a swinging center 46C of the movable frame 36, is positioned at the center of the belt portion at the upper side and the belt portion at the lower side.

In other words, as shown in FIG. 1, the shaft portion 46 is disposed at an intermediate position between a belt portion 28L that contacts the photoreceptor drums 11A, 11B and a belt portion 28U that is at the upper side of the belt portion 28L and opposes the belt portion 28L, between a normal line SA at a belt contacting portion FA of the photoreceptor drum 11A for monochrome and a normal line SB at a belt contacting portion FB of the photoreceptor drum 11B that is adjacent to the photoreceptor drum 11A for monochrome. To explain in more detail, as shown in FIG. 1 and FIG. 4, the swinging center 46C (the center of the shaft portion 46) is positioned on a straight line S2 that connects a central point M1, of a straight line 51 connecting a rotational center 20C of the supporting roller 20 and a rotational center 22C of the supporting roller 22, and a rotational center 24C of the steering roller 24 in the color mode. Accordingly, even when the movable frame 36 swings around the shaft portion 46, the shaft portion 46 does not contact the belt 28.

In the color mode, the belt 28 contacts all of the photoreceptor drums 11A-D. Further, in the monochrome mode, the position of the movable frame 36 is switched, the belt 28 is set in a state of contacting only the photoreceptor drum 11A and not contacting the photoreceptor drums 11B-D, and wear of the photoreceptor drums 11 and consumption of toner from the developing units are suppressed.

In this way, the position of the swinging center 46C is made to be an intermediate position between the belt portions 28L and 28U. Due thereto, even when the movable frame swings around the shaft portion 46 for switching between the monochrome mode and the color mode, fluctuations in the belt tension are suppressed, and the load applied to the belt is low.

The swinging center 46C is positioned on the straight line S2 that connects the central point M1 of the straight line 51, and the rotational center 24C of the steering roller 24 in the color mode. The aforementioned fluctuations in the belt tension are thereby kept to a minimum.

The steering roller 24 is provided at a roller for support at the movable frame side. The steering roller 24 moves in the direction orthogonal to the feeding direction of the belt 28 and carries out adjustment of meandering of the belt 28. Due thereto, the steering roller 24 is disposed at a position at which it is structurally easy to place the steering roller 24, and further, at a position that is far from the supporting rollers 20, 22.

Further, due to the tension coil springs 42, the belt 28 is stretched at the steering roller 24, and the end portion members 24E are pushed against the blocks 44. Accordingly, it suffices to not separately provide a mechanism that imparts the pressure-imparting direction force F2 and a mechanism that imparts the belt tensile force F3, and the number of parts is reduced.

(Electricity Supplying Mechanism)

Figure 10:
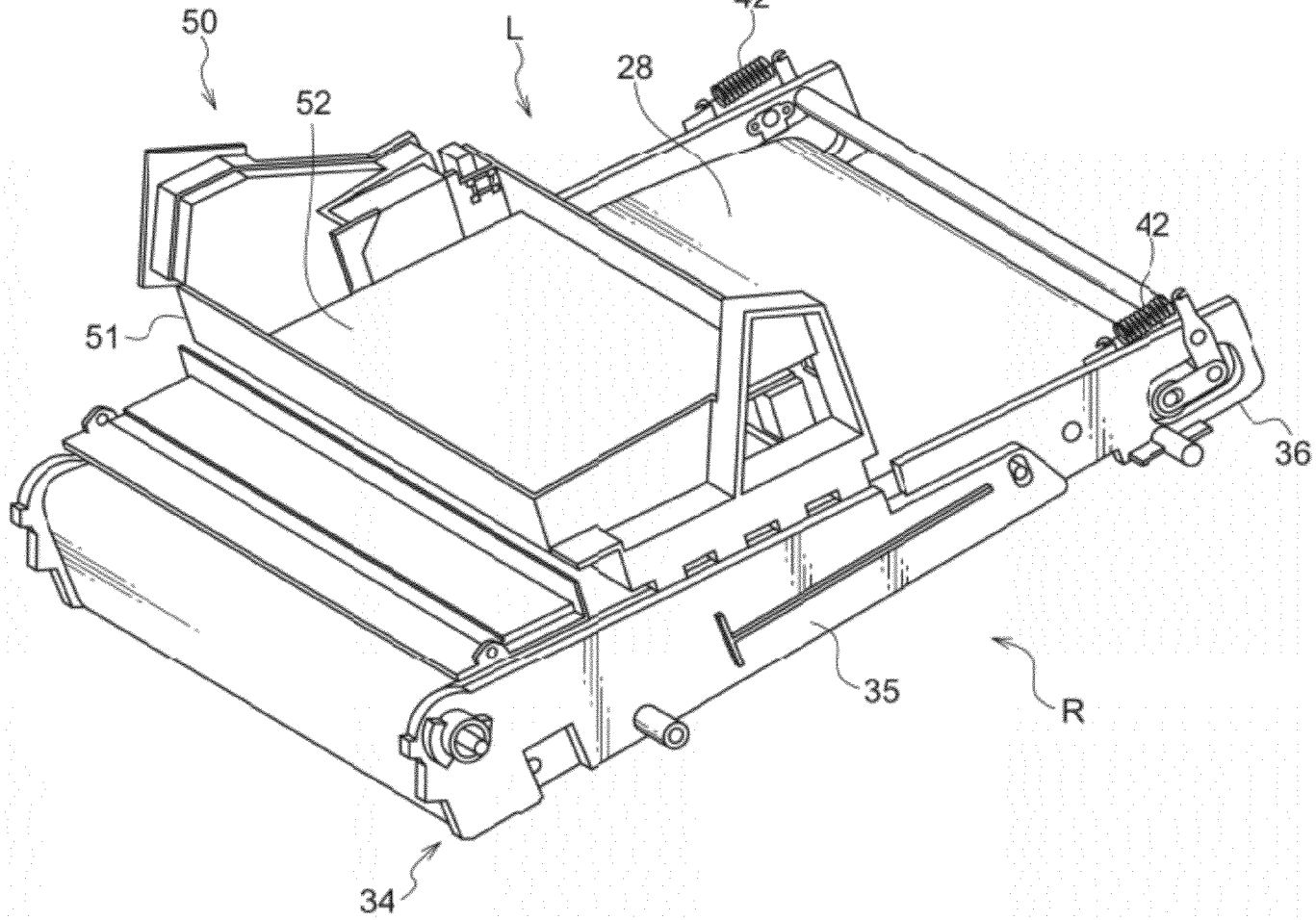
FIG. 10 is a perspective view explaining a power supply unit being provided at the upper side of the belt unit relating to the exemplary embodiment of the present invention.
Figure 11:
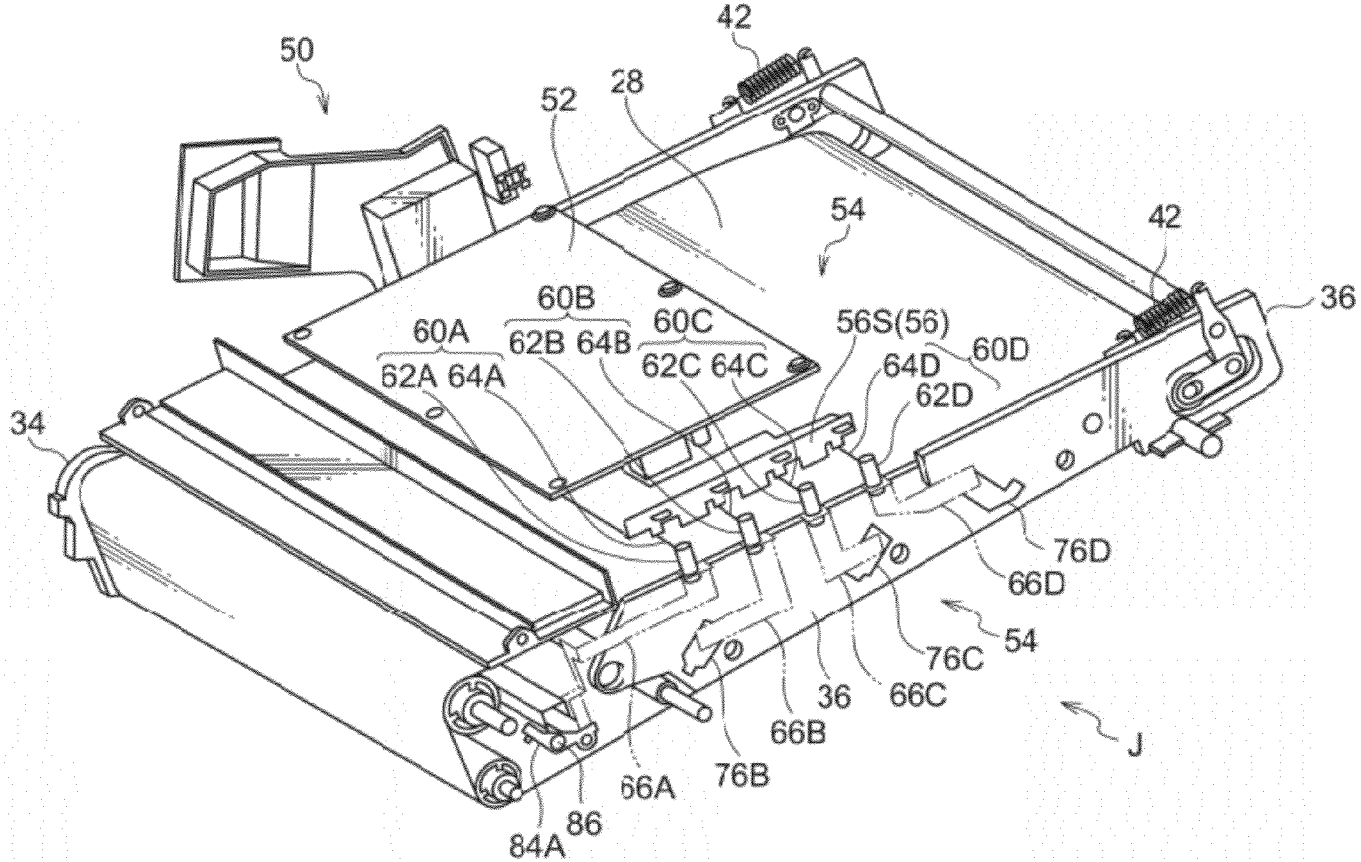
FIG. 11 is a perspective view explaining a power supplying mechanism being provided at one side portion of the belt unit relating to the exemplary embodiment of the present invention (an explanatory drawing in which a movable unit side portion is illustrated)
Figure 12:
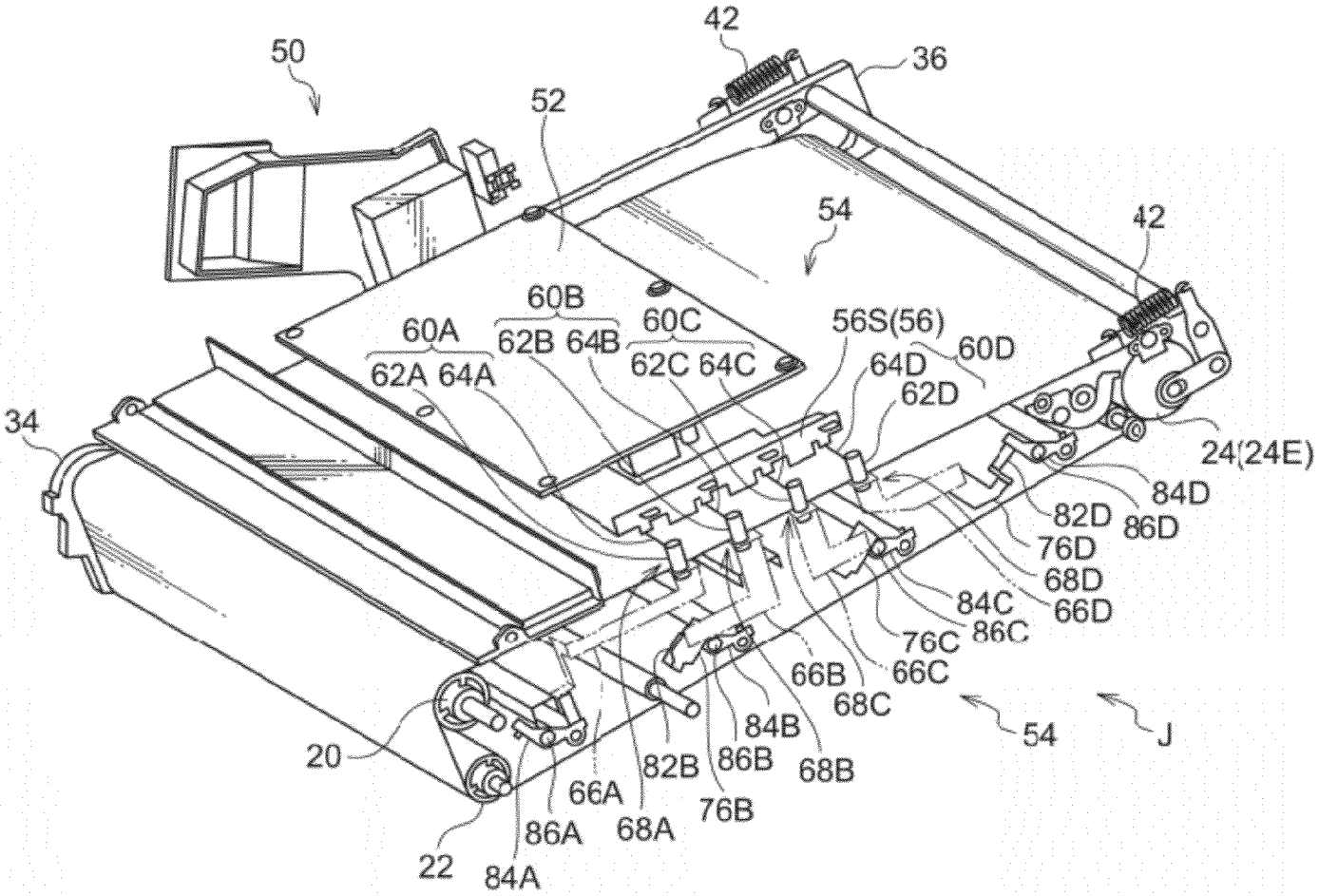
FIG. 12 is a perspective view explaining the power supplying mechanism being provided at the one side portion of the belt unit relating to the exemplary embodiment of the present invention (an explanatory drawing in which the movable unit side portion is not illustrated)

As shown in FIG. 10 through FIG. 12, an electricity supplying mechanism 54, that supplies electric power from a power supply unit 50 to the fixed frame 34 side even when the movable frame 36 swings around the shaft portion 46, is provided at the printer 1.

At the electricity supplying mechanism 54, the power supply unit 50 is provided at the upper side of the belt unit 10. The power supply unit 50 has a power supply housing 51 that is fixed to the upper edge side of the fixed frame 34, a high voltage power supply substrate 52 that is fixed to the power supply housing 51, and an electricity supplying substrate 56 that is electrically connected to the high voltage power supply substrate 52 and has an electricity supplying section 56S that is parallel to the movable frame 36.

Further, electric power receiving/supplying portions 60A-D, that are disposed at the upper edge side of the fixed frame side portion 35, are provided at the electricity supplying mechanism 54. The electric power receiving/supplying portions 60A-D respectively have compression coil springs 62A-D and extending portions 64A-D that extend from the compression coil springs 62A-D respectively and are electrically connected to the lower edge of the electricity supplying section 56S. Accordingly, the extending portions 64A-D are respectively pushed to contact the electricity supplying section 56S by the pushing forces of the compression coil springs. All of the compression coil springs 62A-D and the extending portions 64A-D are structured by conductive members. Note that the extending portions 64A-D may be formed by drawing-out the compression coil springs 62A-D.

Conductive plate portions 66A-D at the fixed frame side, that are conductive with the electric power receiving/supplying portions 60A-D respectively, are provided at the electricity supplying mechanism 54. The conductive plate portions 66A-D are provided at the fixed frame 34, and respective upper end portions of the conductive plate portions 66A-D are exposed at the upper edge side of the fixed frame 34. Further, connecting portions 68A-D that fix the compression coil springs 62A-D are formed at these respective upper end portions.

The conductive plate portion 66A is a member that is machined so as to extend from the upper edge side toward the lower edge side of the fixed frame side portion 35, and midway therealong, bend toward the supporting rollers 20, 22, and extend toward the lower edge side of the fixed frame side portion 35, and supply electricity to the primary transfer roller 30A.

Figure 13:
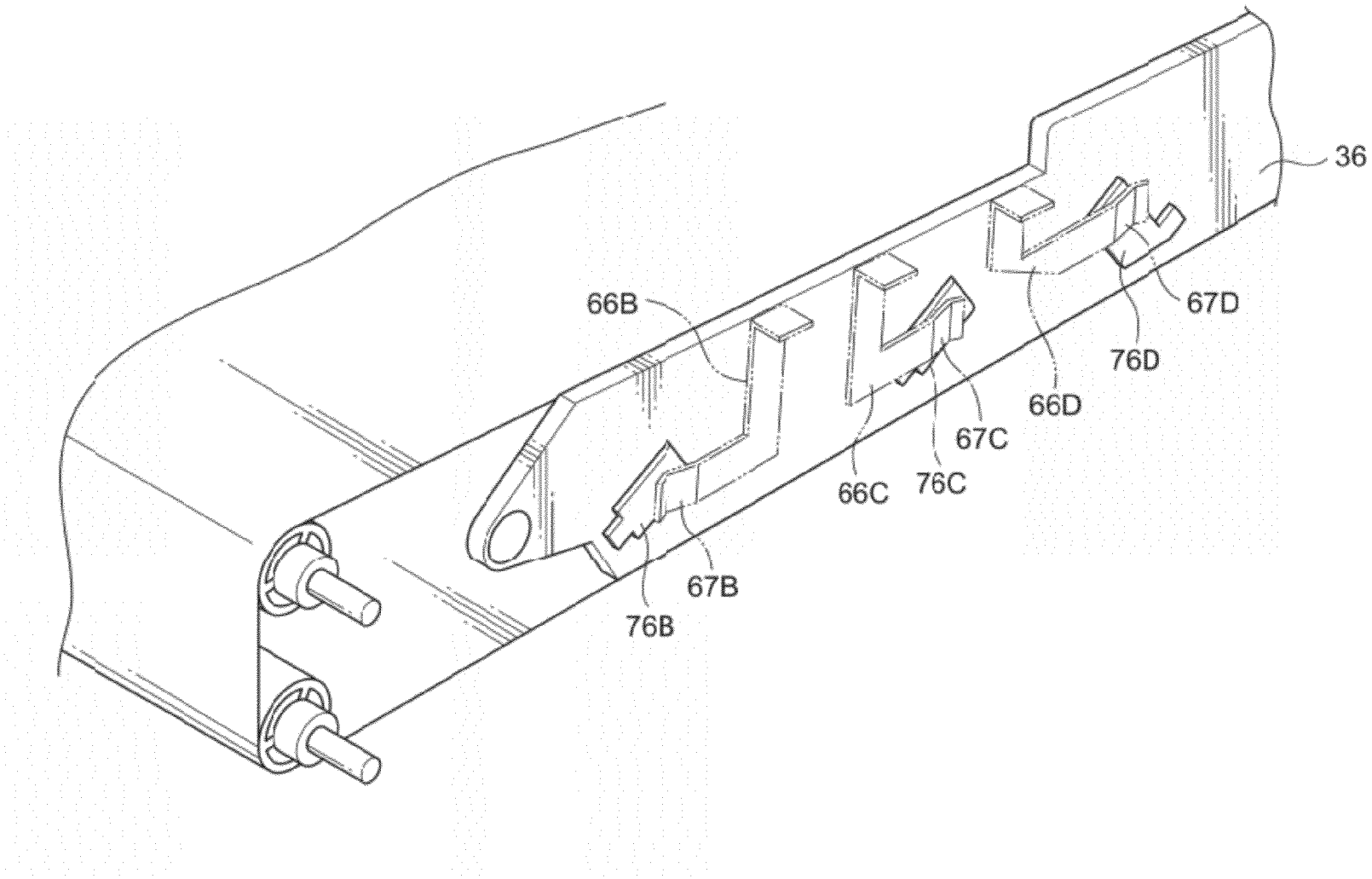
FIG. 13 is a perspective view explaining a conductive plate portion at a fixed frame side and a conductive plate portion at a movable frame side contacting while sliding at the belt unit relating to the exemplary embodiment of the present invention (the state of the color mode)
Figure 14:
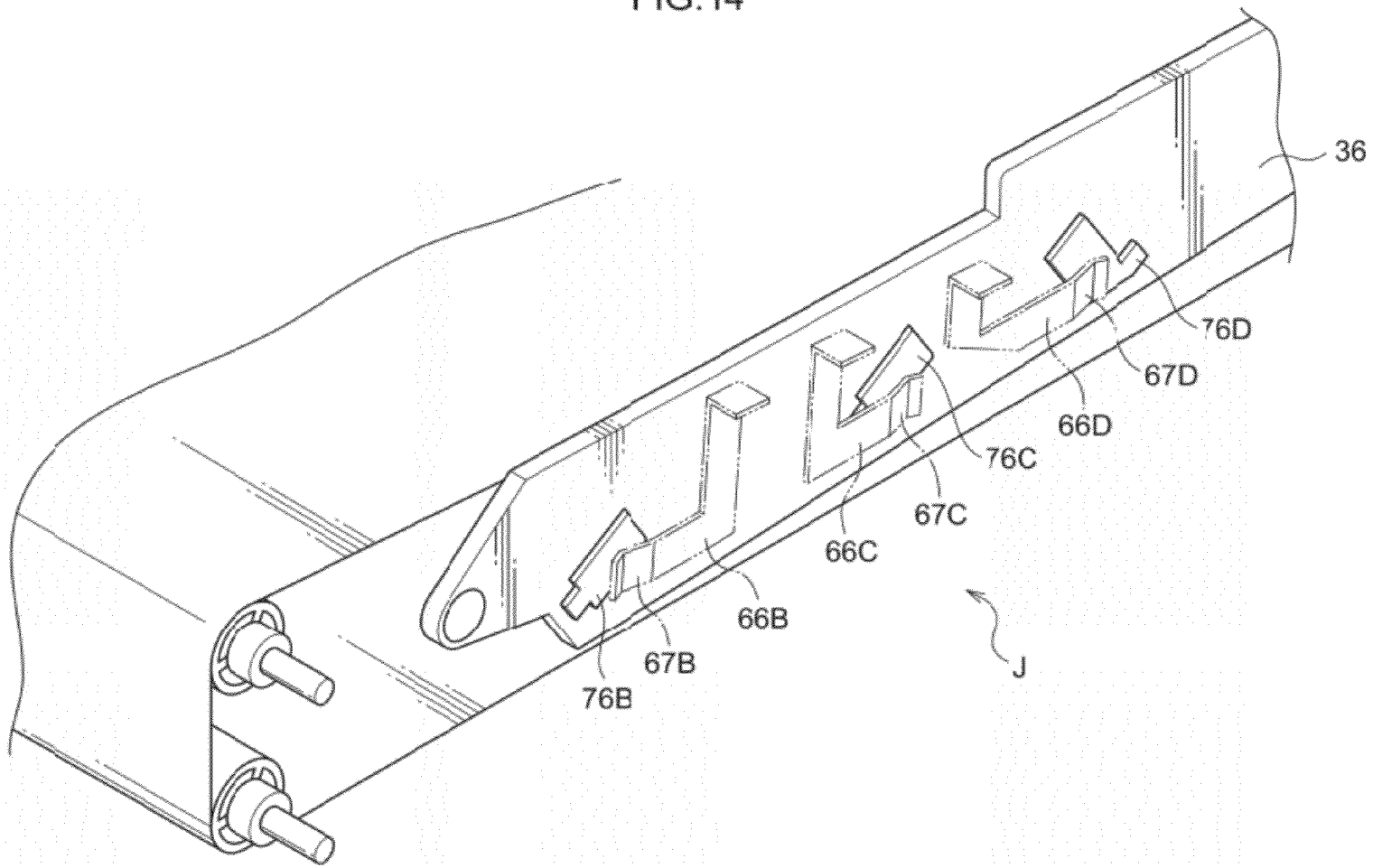
FIG. 14 is a perspective view explaining the conductive plate portion at the fixed frame side and the conductive plate portion at the movable frame side contacting while sliding at the belt unit relating to the exemplary embodiment of the present invention (the state of the monochrome mode)

The conductive plate portion 66B is a member that is L-shaped as seen from direction J in FIG. 11 and FIG. 12 (i.e., as seen from the side surface side of the belt unit 10), and extends from the upper edge side toward the lower edge side of the fixed frame side portion 35, and midway therealong, bends toward the supporting rollers 20, 22. Further, as shown in FIG. 13 and FIG. 14, a plate spring portion 67B is formed at the distal end side thereof.

The conductive plate portion 66C is a member that is L-shaped as seen from the J direction, and extends from the upper edge side toward the lower edge side of the fixed frame side portion 35, and midway therealong, bends toward the steering roller 24. Further, a plate spring portion 67C is formed at the distal end side thereof.

The conductive plate portion 66D as well is a member that is L-shaped as seen from the J direction, and extends from the upper edge side toward the lower edge side of the fixed frame side portion 35, and midway therealong, bends toward the steering roller 24. Further, a plate spring portion 67D is formed at the distal end side thereof.

All of the plate spring portions 67B-D are structured so as to urge toward the fixed frame inner side, i.e., toward electricity-receiving plate portions 78B-D that will be described later.

As shown in FIG. 11 through FIG. 16, conductive plate portions 76B-D at the movable frame side, that contact the conductive plate portions 66B-D respectively and transfer electric power to the primary transfer rollers 30B-D, are provided at the electricity supplying mechanism 54. The conductive plate portions 76B-D are provided at the movable frame 36.

Figure 15:
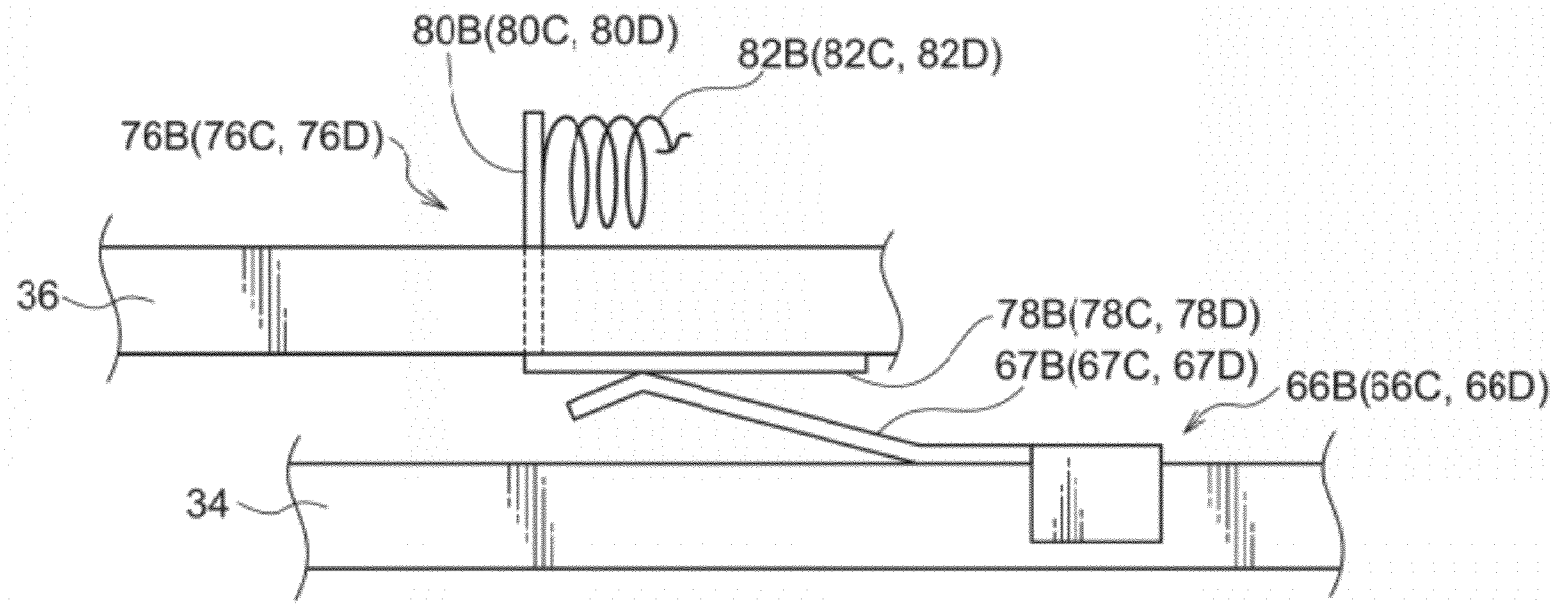
FIG. 15 is a schematic plan view explaining the conductive plate portion at the fixed frame side and the conductive plate portion at the movable frame side always contacting while sliding at the belt unit relating to the exemplary embodiment of the present invention.

As shown in FIG. 15, the conductive plate portion 76B has an electricity receiving plate portion 78B that is exposed at the outer side (the fixed frame side) of the movable frame 36, and an electricity supplying plate portion 80B that passes through the movable frame 36 and extends to the inner side of the movable frame 36.

The conductive plate portion 76C also has a similar structure, and has an electricity receiving plate portion 78C that is exposed at the outer side of the movable frame 36, and an electricity supplying plate portion 80C that passes through the movable frame 36 and extends to the inner side of the movable frame 36.

The conductive plate portion 76D as well has an electricity receiving plate portion 78D that is exposed at the outer side of the movable frame 36, and an electricity supplying plate portion 80D that passes through the movable frame 36 and extends to the inner side of the movable frame 36.

The positions at which the electricity receiving plate portions 78B-D are disposed are positions at which the plate spring portions 67B-D always contact the electricity receiving plate portions 78B-D respectively while sliding, even when the movable frame 36 swings around the swinging center 46C.

Compression coil springs 82B-D, that are electrically conductive and are provided at the inner side of the movable frame 36, and the holding members 84 that are formed of an electrically conductive resin, are provided at the electricity supplying mechanism 54. At one ends thereof, the compression coil springs 82B-D abut the electricity supplying plate portions 80B-D, and, at the other ends thereof, the compression coil springs 82B-D abut the holding members 84B-D. The holding members 84B-D are able to rotate in both directions due to rotating shafts 86B-D. Further, due to the urging forces from the compression coil springs 82B-D, the holding members 84B-D urge the primary transfer rollers 30B-D toward the lower edge portion side of the movable frame 36.

Note that, as shown in FIG. 4, FIG. 11 and FIG. 12, the holding member 84A, that is conductive and rotatably holds the end portion of the of the primary transfer roller 30A, is provided at the inner side of the fixed frame 34. The holding member 84A is held at the fixed frame 34 by a rotating shaft 86A so as to be able to rotate in both directions. Further, a compression coil spring 82A that is electrically conductive is mounted to the lower end of the conductive plate portion 66A. The lower end of the compression coil spring 82A positions the primary transfer roller 30A by urging the primary transfer roller 30A toward the lower edge portion of the fixed frame 34 via the holding member 84A.

By providing the electricity supplying mechanism 54, the conductive plate portions 76B-D and the conductive plate portions 66B-D are always contacting each other respectively, even when the movable frame 36 swings around the swinging center 46C. Accordingly, the electric power from the power supply unit 50 passes through the conductive plate portions 66B-D and the conductive plate portions 76B-D, and passes through the compression coil springs 82B-D and the holding members 84B-D, and is supplied to the primary transfer rollers 30B-D that are provided at the movable frame 36.

Further, because the plate spring portions 67B-D are pushed and urged by the electricity receiving plate portions 78B-D, the electrical contact between the plate spring portions 67B-D and the electricity receiving plate portions 78B-D is good even when the movable frame 36 swings around the swinging center 46C.

The extending portions 64A-D of the electric power receiving/supplying portions 60A-D are urged toward and contact the lower end of the electricity supplying portion 56S by the compression coil springs 62A-D for receiving/supplying. Accordingly, the electrical contact between the electricity supplying substrate 56 and the electric power receiving/supplying portions 60A-D is good.

The compression coil springs 82B-D that are conductive push and contact the electricity supplying plate portions 80B-D, and the compression coil springs 82B-D push and contact the holding members 84B-D that are conductive. Further, the holding members 84B-D rotatably hold the primary transfer rollers 30B-D. Accordingly, the electrical contact from the conductive plate portions 66B-D to the primary transfer rollers 30B-D is good. Moreover, the number of parts is reduced because there is a structure in which electricity is supplied to the primary transfer rollers 30B-D through the holding members 84B-D that are formed of an electrically conductive resin.

Note that, in the present exemplary embodiment, explanation is given of an example in which the belt 28 is an intermediate transfer belt (an intermediate primary transfer belt). However, the belt may be a sheet conveying belt.

An exemplary embodiment of the present invention has been described above by using an example, but the above-described exemplary embodiment is an example and can be implemented by being changed in various ways within a scope that does not deviate from the gist of the present invention. Further, the scope of the present invention is, of course, not limited to the above-described exemplary embodiment.

What is claimed is:

1. A belt unit comprising:

a fixed frame at which a transfer roller is provided;

a plurality of fixed side supporting rollers provided at the fixed frame;

a movable frame that is swingably mounted to the fixed frame, and at which a plurality of transfer rollers are provided;

a movable side supporting roller provided at the movable frame; and an endless belt stretched around the fixed side supporting rollers and the movable side supporting roller, and contacting the transfer roller provided at the fixed frame and the transfer rollers supported at the movable frame, and contacting a plurality of photoreceptor drums, wherein a swinging center of the movable frame is a center of belt portions at both sides of the swinging center, and in a monochrome mode, the movable frame is swung and moves the belt away from the photoreceptor drums other than the photoreceptor drum that is used in the monochrome mode, wherein two rollers are provided as the fixed side supporting rollers, and the swinging center is positioned on a line that connects a central point of a line connecting rotational centers of the two rollers, and a rotational center of the movable side supporting roller in a color mode.

2. The belt unit of claim 1, wherein the movable side supporting roller is a steering roller that moves in a direction orthogonal to a feeding direction of the belt and carries out adjustment of meandering of the belt.

3. The belt unit of claim 2, wherein an urging portion that urges the steering roller so as to stretch the belt is provided.

4. The belt unit of claim 1, wherein the fixed frame extends to a position at which the transfer rollers provided at the movable frame are disposed, and an electricity supplying mechanism, that supplies electricity via the fixed frame to the transfer rollers provided at the movable frame, is provided.

5. The belt unit of claim 4, wherein a movable frame side conductive plate portion, to which electricity is supplied from the fixed frame side, is provided at the movable frame, and a fixed frame side conductive plate portion, that has a spring portion that contacts the conductive plate portion while urging the conductive plate portion, is provided at the fixed frame.

6. The belt unit of claim 1, wherein the belt is an intermediate transfer belt or a sheet conveying belt.

7. An image forming device comprising the belt unit of claim 1.

8. A belt unit comprising:

a fixed frame at which a transfer roller is provided;

a plurality of fixed side supporting rollers provided at the fixed frame;

a movable frame that is swingably mounted to the fixed frame, and at which a plurality of transfer rollers are provided;

a movable side supporting roller provided at the movable frame; and an endless belt stretched around the fixed side supporting rollers and the movable side supporting roller, and contacting the transfer roller provided at the fixed frame and the transfer rollers supported at the movable frame, and contacting a plurality of photoreceptor drums, wherein a swinging center of the movable frame is positioned substantially at a center between a belt portion at an upper side of the swinging center and a belt portion at a lower side of the swinging center, in a monochrome mode, the movable frame is swung and moves the belt away from the photoreceptor drums other than the photoreceptor drum that is used in the monochrome mode, the fixed frame extends to a position at which the transfer rollers provided at the movable frame are disposed, an electricity supplying mechanism, that supplies electricity via the fixed frame to the transfer rollers provided at the movable frame, is provided, a movable frame side conductive plate portion, to which electricity is supplied from the fixed frame side, is provided at the movable frame, and a fixed frame side conductive plate portion, that has a spring portion that contacts the conductive plate portion while urging the conductive plate portion, is provided at the fixed frame.

9. The belt unit of claim 8, wherein the movable side supporting roller is a steering roller that moves in a direction orthogonal to a feeding direction of the belt and carries out adjustment of meandering of the belt.

10. The belt unit of claim 9, wherein an urging portion that urges the steering roller so as to stretch the belt is provided.

11. The belt unit of claim 8, wherein the belt is an intermediate transfer belt or a sheet conveying belt.

12. An image forming device comprising the belt unit of claim 8.

13. A belt unit comprising:

a fixed frame at which a transfer rover is provided;

a plurality of fixed side supporting rovers provided at the fixed frame;

a movable frame that is swingably mounted to the fixed frame, and at which a plurality of transfer rollers are provided:

a movable side supporting roller provided at the movable frame; and an endless belt stretched around the fixed side supporting rollers and the movable side supporting roller, and contacting the transfer roller provided at the fixed frame and the transfer rollers supported at the movable frame, and contacting a plurality of photoreceptor drums, wherein a swinging center of the movable frame is a center of belt portions at both sides of the swinging center, in a monochrome mode, the movable frame is swung and moves the belt away from the photoreceptor drums other than the photoreceptor drum that is used in the monochrome mode, the fixed frame extends to a position at which the transfer rollers provided at the movable frame are disposed, an electricity supplying mechanism, that supplies electricity via the fixed frame to the transfer rollers provided at the movable frame, is provided, a movable frame side conductive plate portion, to which electricity is supplied from the fixed frame side, is provided at the movable frame, and a fixed frame side conductive plate portion, that has a spring portion that contacts the conductive plate portion while urging the conductive plate portion, is provided at the fixed frame.

14. The belt unit of claim 13, wherein two rollers are provided as the fixed side supporting rollers, and the swinging center is positioned on a line that connects a central point of a line connecting rotational centers of the two rollers, and a rotational center of the movable side supporting roller in a color mode.

15. The belt unit of claim 13, wherein the movable side supporting roller is a steering roller that moves in a direction orthogonal to a feeding direction of the belt and carries out adjustment of meandering of the belt.

16. The belt unit of claim 15, wherein an urging portion that urges the steering roller so as to stretch the belt is provided.

17. The belt unit of claim 13, wherein the belt is an intermediate transfer belt or a sheet conveying belt.

* * * * *